US007099601B2

(12) United States Patent
Takiguchi et al.

(10) Patent No.: US 7,099,601 B2
(45) Date of Patent: Aug. 29, 2006

(54) IMAGE FORMING APPARATUS

(75) Inventors: Toshiki Takiguchi, Yamatokoriyama (JP); Hiroyuki Murai, Yamatokoriyama (JP); Yoshiaki Masuda, Nara (JP); Noriaki Taguchi, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/242,225

(22) Filed: Oct. 3, 2005

(65) Prior Publication Data

US 2006/0072930 A1 Apr. 6, 2006

(30) Foreign Application Priority Data

Oct. 5, 2004 (JP) ..... 2004-292734

(51) Int. Cl.
*G03G 15/00* (2006.01)

(52) U.S. Cl. ..... 399/66; 399/297; 399/303; 399/313

(58) Field of Classification Search ..... 399/38, 399/50, 61, 66, 49, 303, 313, 297
See application file for complete search history.

(56) References Cited

U.S. PATENT DOCUMENTS 5,164,776 A * 11/1992 Oresick et al. ..... 399/50
5,659,843 A * 8/1997 Takano et al. ..... 399/66
5,946,523 A * 8/1999 Fujioka et al. ..... 399/49
6,477,339 B1 * 11/2002 Yano et al. ..... 399/66
6,829,465 B1 * 12/2004 Yamanaka et al. ..... 399/301
6,911,993 B1 * 6/2005 Nishikawa et al. ..... 347/116
2004/0247335 A1 * 12/2004 Inoue et al. ..... 399/69

FOREIGN PATENT DOCUMENTS

| | | |
|---|---|---|
| JP | 10-161436 | 6/1998 |
| JP | 11-202647 | 7/1999 |
| JP | 2003-248409 | 9/2003 |

* cited by examiner

*Primary Examiner*—Andrew H. Hirshfeld
*Assistant Examiner*—Dave A. Ghatt
(74) *Attorney, Agent, or Firm*—Renner, Otto, Boisselle and Sklar, LLP

(57) ABSTRACT

An image forming apparatus includes an endless belt stretched over a plurality of rollers. The apparatus also includes a potential detecting device for detecting a potential of the endless belt. The detecting device is positioned downstream, along a sheet transport path, of a transfer position where the belt has direct contact with the image bearing member. The apparatus further includes a transferring member for transferring a toner image formed on the image bearing member to a sheet. An image forming process is halted when the potential detecting device does not detect a change in potential caused by presence of a sheet on the endless belt.

4 Claims, 3 Drawing Sheets

IMAGE FORMING APPARATUS

CROSS REFERENCE

This Nonprovisional application claims priority under 35 U.S.C. § 119(a) on Patent application Ser. No. 2004-292734 filed in Japan on Oct. 5, 2004, the entire contents of which are hereby incorporated by reference.

BACKGROUND OF THE INVENTION

The invention relates to an image forming apparatus in which a toner image formed on an image bearing member is transferred to a sheet which is being transported on an endless belt rotatably stretched over a plurality of rollers including a driving roller.

Most of recent image forming apparatuses are multifunctional in that they can operate under multiple processing modes such as copying mode, printing mode, or facsimile mode. Also, such recent image forming apparatuses have high-speed printing capability and achieve a processing rate of one or more sheets per second.

To perform high-speed processing, such apparatuses consecutively feed a plurality of sheets thereinto so that the sheets undergo consecutive image forming processes.

The apparatuses are provided with a sheet feeding sensor for detecting that a sheet starts being fed, and a sheet ejection sensor for detecting that a sheet is ejected. The apparatuses determine where therein a sheet as fed is positioned, based on sheet transport speed and time elapsed since the sheet starts being fed with reference to a sheet feeding start time as detected by the sheet feeding sensor.

However, it is difficult to maintain a constant sheet transport speed because of various types of sheets to be used for image formation and because of various conditions under which the apparatuses may be used. A decrease in sheet transport speed in a part of sheet transport path prevents a sheet from being transported timely to sheet transporting members positioned downstream of the part. At worst, the delay results in a sheet jam. A jammed sheet also may damage essential components such as an image bearing member.

As a solution to the foregoing problems, JP H10-161436A discloses an image forming apparatus in which a charging voltage for recharging a toner image carried on a sheet is adjusted according to a potential of the sheet as measured. Toner on a sheet being transported on a transport belt needs to be re-charged so as to be more attracted to the sheet before the sheet is transported into the fusing device. If the toner is excessively charged, however, the sheet is also attracted to the transport belt and thus may cause a jam. The apparatus of JP H10-161436A is intended for preventing such a sheet jam.

JP H11-202647A proposes another solution. An image forming apparatus as disclosed by JP H11-202647A detects whether a sheet passing beyond a portion of an intermediate transfer belt which faces a second transfer device remains on the intermediate transfer belt. If the sheet remains on the belt, an outer second transfer roller provided in the second transfer device is moved out of contact with a surface of the belt. Then, an image bearing member and the belt are deactivated so as to stop transporting the sheet after a predetermined time elapsed since deactivation of the image bearing member and the belt.

A sheet to which a toner image is transferred from the image bearing member at a transfer position is attracted to a circumferential surface of the image bearing member by a surface potential thereof. Thus, a separating claw is provided at a separation position located downstream of the transfer position on the circumferential surface of the image bearing member, in order to separate the sheet from the circumferential surface. The separating claw is moved selectively in or out of direct contact with the image bearing member, according to sheet transport timing.

If there is a delay in transporting a sheet, however, a leading end of the sheet reaches the separation position with the separating claw away from the image bearing member. Without being separated from the circumferential surface of the image bearing member, the sheet is guided by rotation of the image bearing member to a cleaning section provided downstream of the separating claw, so that the sheet gets jammed in the cleaning section. The sheet jam in the cleaning section may damage the cleaning section itself and the surface of the image bearing member. Further, clearing a sheet jam in the cleaning section is a difficult task which an operator finds rather bothersome.

A feature of the invention is to provide an image forming apparatus in which an image bearing member is deactivated, according to determination that a sheet is not separated from the image bearing member, when a sheet is not detected at a predetermined timing at a predetermined position located downstream of a transfer position along a sheet transport path. The configuration prevents occurrence of a sheet jam in a cleaning section, thereby saving an operator from having to do the difficult task of clearing the sheet jam.

SUMMARY OF THE INVENTION

An image forming apparatus of the invention includes a plurality of rollers, a transferring member including an endless belt that is stretched over the rollers, and a potential detecting device for detecting a potential of the endless belt. The potential detecting device is positioned downstream, along a sheet transport path, of a transfer position where the endless belt has direct contact with an image bearing member. An image forming process is halted when the potential detecting device does not detect a change in potential caused by presence of a sheet on the endless belt.

DETAILED DESCRIPTION OF THE INVENTION

With reference to the accompanying drawings, an image forming apparatus according to preferred embodiments of the invention will be described in detail below.

Figure 1:
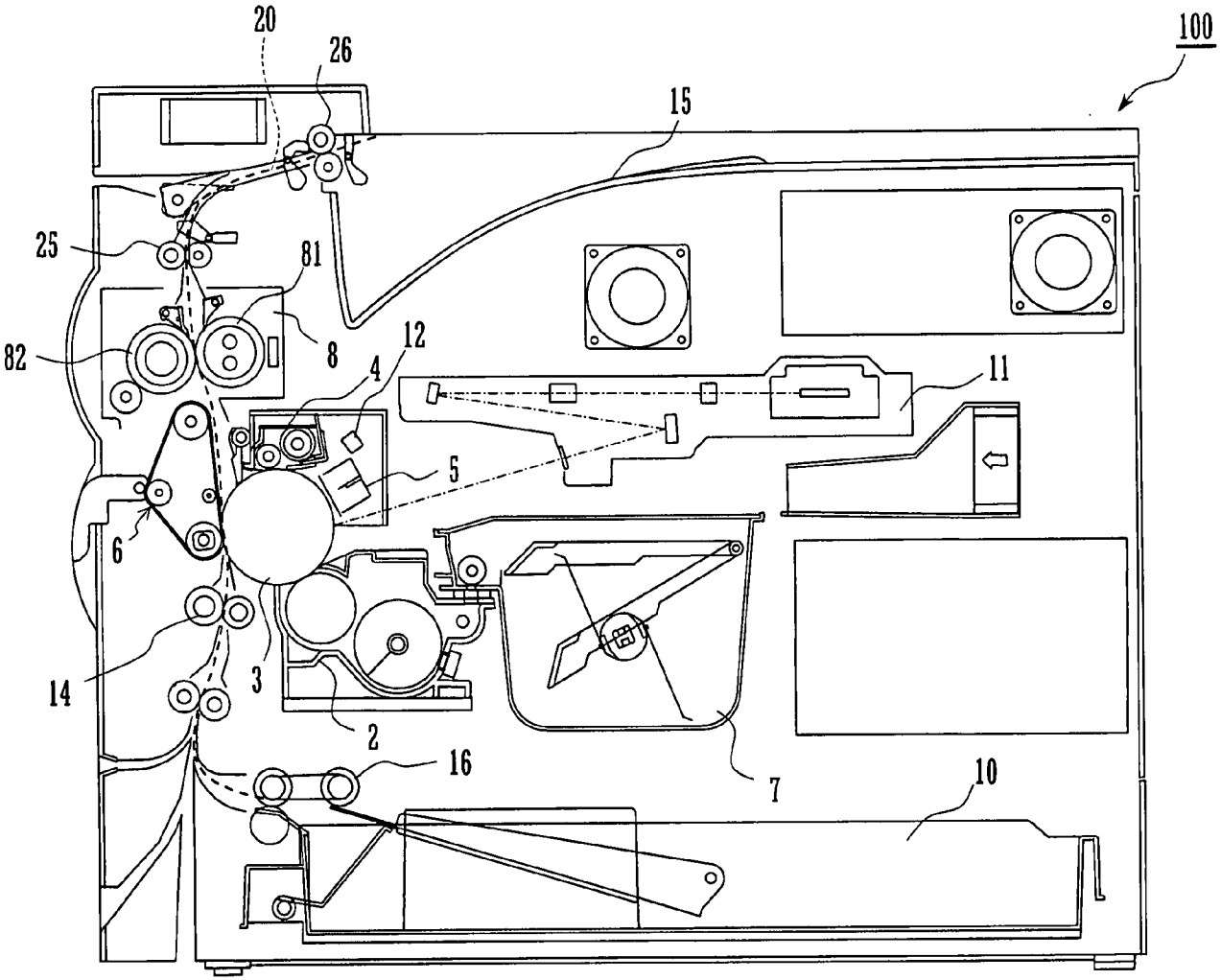
FIG. 1 is a schematic diagram illustrating a configuration of an image forming apparatus according to an embodiment of the invention.

FIG. 1 is a schematic diagram illustrating a configuration of an image forming apparatus 100 according to an embodiment of the invention. The image forming apparatus 100 is a laser printer. In an inner left-side portion of the image forming apparatus 100, a photoreceptor drum 3 as the image bearing member of the invention is rotatably supported. A charger 5, a developing unit 2, a transfer unit 6, a cleaning device 4, and a discharger 12 are arranged around the photoreceptor drum 3 in the mentioned order along a rotational direction of the photoreceptor drum 3.

An exposure unit 11 is provided in an inner middle portion of the image forming apparatus 100. The exposure unit 11 irradiates laser light that is modulated according to image data, on a portion of a circumferential surface of the photoreceptor drum 3 between respective positions where the photoreceptor drum 3 faces the charger 5 and the developing unit 2.

A sheet feeding cassette 10 is installed in an inner bottom portion of the image forming apparatus 100. The sheet feeding cassette 10 has a plurality of sheets stored therein. A sheet receiving tray 15 is provided on a top surface of the image forming apparatus 100. Inside the image forming apparatus 100, a sheet transport path 20 is formed so as to lead from the sheet feeding cassette 10, between the photoreceptor drum 3 and the transfer unit 6, to the sheet receiving tray 15. Arranged along the sheet transport path 20 are a sheet feeding roller 16, registration rollers 14, a fusing unit 8, and sheet ejecting rollers 26.

The sheet feeding roller 16 picks up and feeds a top one of the sheets stored in the sheet feeding cassette 10, into the sheet transport path 20. A sheet as fed is set straight by the registration rollers 14. Then, the sheet is transported to a transfer position where the photoreceptor drum 3 faces the transfer unit 6, in such timing that a leading end of the sheet meets a leading end of toner image formed on the photoreceptor drum 3.

On the other hand, the circumferential surface of the photoreceptor drum 3 is uniformly charged by the charger 5 and then irradiated with laser light from the exposure unit 11. Subsequently, a resulting electrostatic latent image on the circumferential surface is developed into a toner image with toner supplied by the developing unit 2. The developing unit 2 is fed with toner by a hopper 7.

At the transfer position, a toner image formed on the photoreceptor drum 3 is transferred onto a sheet with a transfer bias voltage applied to the transfer unit 6. The sheet with the toner image transferred is transported between a heat roller 81 and a pressure roller 82 in the fusing unit 8, in order to be heated and pressed. The toner image is thus firmly fixed to the sheet. Then, the sheet with the fixed toner image is ejected to the sheet receiving tray 15 by the sheet ejecting rollers 26.

After passing through the transfer position, the circumferential surface of the photoreceptor drum 3 is cleared of residual toner or paper dust by the cleaning device 4 and discharged by the discharger 12, for subsequent image forming operations.

Figure 2:
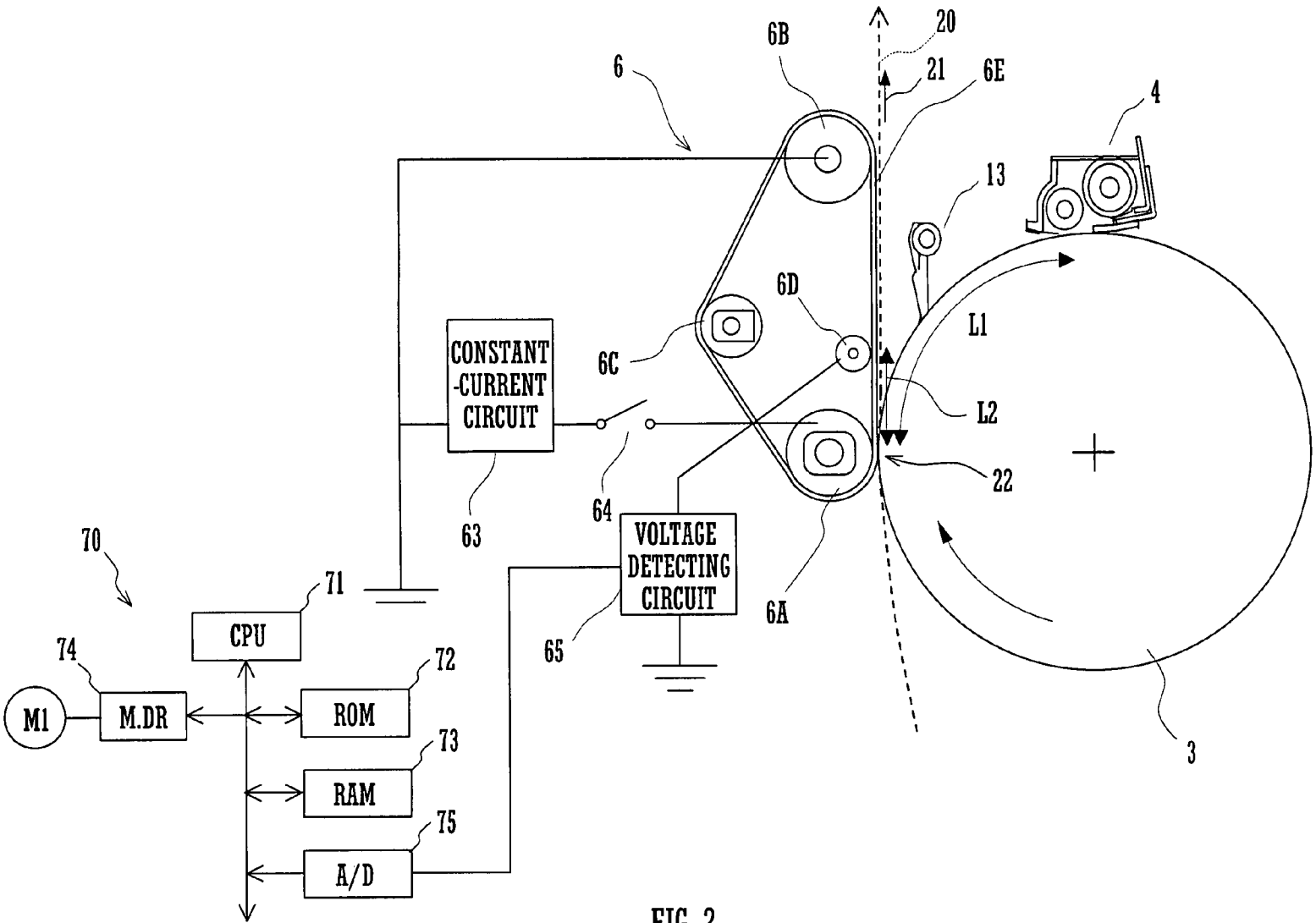
FIG. 2 is a block diagram illustrating a configuration of a transfer unit of the image forming apparatus.

FIG. 2 is a block diagram illustrating a configuration of the transfer unit 6 of the image forming apparatus 100. The transfer unit 6 includes a transfer roller 6A, a driving roller 6B, a tension roller 6C, a potential detecting roller 6D, and a transfer belt 6E. The transfer belt 6E is a high-resistance endless belt stretched over the rollers 6A through 6D.

The transfer roller 6A has direct contact with the circumferential surface of the photoreceptor drum 3, with the transfer belt 6E sandwiched therebetween, at a transfer position 22. To the transfer roller 6A, a transfer bias voltage is applied through a switch 64 from a constant-current circuit 63. Under normal conditions, the switch 64 is closed only when a sheet passes through the transfer position 22. In a case of consecutive image forming operations to multiple sheets, however, the switch 64 is closed during a period from a time when a leading end of the first sheet reaches the transfer position 22 to a time when a trailing end of the last sheet passes through the transfer position 22.

Downstream of the transfer position 22 along the rotational direction of the photoreceptor drum 3, a separating claw 13 and the cleaning device 4 are arranged in the mentioned order, so as to face the circumferential surface of the photoreceptor drum 3. The separating claw 13 is arranged so as to be pivotable between a first position and a second position. In the first position, the claw 13 has direct contact with the circumferential surface of the photoreceptor drum 3. In the second position, the claw 13 is out of contact with the surface of the drum 3. The separating claw 13 brings an edge thereof into direct contact with the circumferential surface of the drum 3, so that a sheet that is electrostatically attracted to the surface at the transfer position 22 is separated from the surface.

If the separating claw 13 constantly has direct contact with the circumferential surface of the photoreceptor drum 3, there is possibility that residual toner or paper dust are caught between the claw 13 and the surface of the photoreceptor drum 3 and damage the surface. Accordingly, the claw 13 is brought into direct contact with the circumferential surface of the photoreceptor drum 3 after a leading end of a sheet passes through the transfer position 22. The claw 13 is then moved to be out of contact with the surface approximately when the leading end of sheet reaches the claw 13.

The potential detecting roller 6D is arranged at a distance L2 downstream from the transfer position 22 along a sheet transport direction as indicated by an arrow 21, so as to have direct contact with the transfer belt 6E. The roller 6D is an electrically conductive roller connected to a voltage detecting circuit 65. The circuit 65 and the roller 6D, which collectively correspond to the potential detecting device of the invention, detect a potential of a portion of the transfer belt 6E on which the belt 6E has direct contact with the roller 6D (hereinafter referred to as the contact portion).

The circuit 65 outputs a detection signal to be input through an A/D converter 75 to a CPU 71 of a control section 70 provided in the image forming apparatus 100. According to detection data input thereto, the CPU 71 activates or deactivates a motor M1 that is provided for driving the photoreceptor drum 3 to rotate.

The distance L2 is set to be shorter than length L1 on the circumferential surface of the photoreceptor drum 3, from the transfer position 22 to a position where the drum 3 faces the cleaning device 4.

Figure 3:
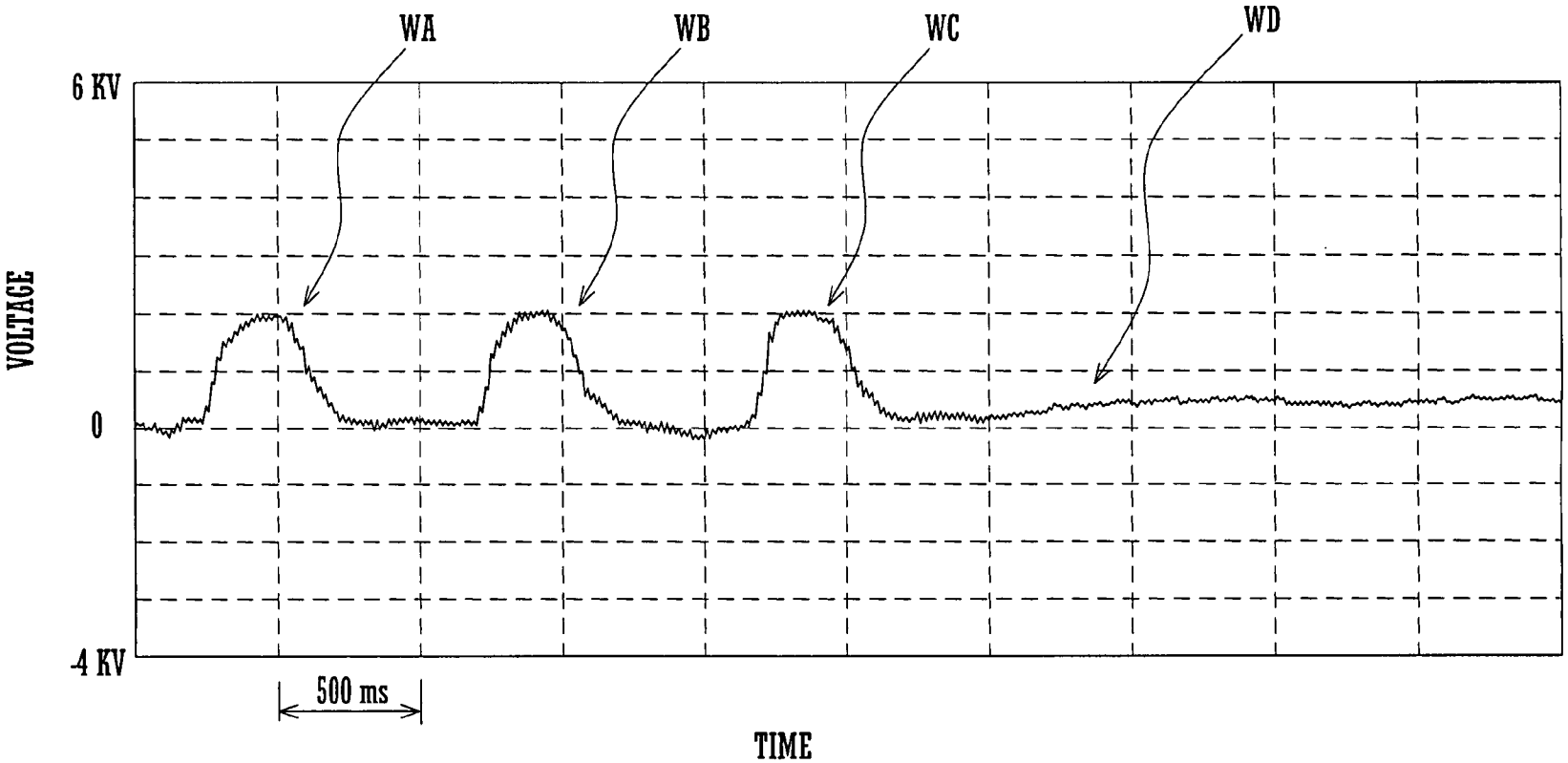
FIG. 3 is a diagram illustrating a pattern of waveform of detection signal output from a voltage detecting circuit in the transfer unit.

FIG. 3 is a diagram illustrating a pattern of waveform of detection signal output from the voltage detecting circuit 65 in the image forming apparatus 100. A sheet that passes through the transfer position 22 is separated from the circumferential surface of the photoreceptor drum 3 and then comes into contact with the contact portion. Through the potential detecting roller 6D, thus, the voltage detecting circuit 65 detects not only a potential of the transfer belt 6E, but also a potential of the sheet that is charged with a bias voltage applied to the photoreceptor drum 3 at the transfer position 22.

Accordingly, in a case of consecutive image forming operations to multiple sheets, the detection signal output from the circuit 65 shows periodic rises, as indicated by waveforms WA through WC in FIG. 3, when the respective sheets are properly separated from the circumferential surface of the photoreceptor drum 3.

When a delay occurs in transporting a sheet, on the other hand, a leading end of the sheet may reach a separation position where the separating claw 13 is to come into contact with the circumferential surface of the photoreceptor drum 3, after the edge of the separation claw 13 is moved out of contact with the circumferential surface of the drum 3. In the case, the sheet does not come into contact with a portion of the transfer belt 6E which has direct contact with the potential detecting roller 6D. Therefore, the detection signal output from the voltage detecting circuit 65 does not show a rise, as indicated by waveform WD in FIG. 3.

Upon detection of a state in which the detection signal output from the circuit 65 does not rise, the CPU 71 stops outputting driving data to a motor driver 74, thereby deactivating the motor M1 to stop driving the photoreceptor drum 3.

Thus, a sheet that is not separated from the circumferential surface of the photoreceptor drum 3 is prevented from reaching the cleaning device 4. This prevents occurrence of a sheet jam in the cleaning device 4 and avoids damages to the cleaning device 4 and the photoreceptor drum 3 caused by a jammed sheet. Accordingly, an operator is saved from the rather bothersome task of clearing a sheet jam.

As described above, the distance L2, along the sheet transport direction, from the transfer position 22 to a position where the potential detecting roller 6D is provided is set shorter than the length L1, on the circumferential surface of the photoreceptor drum 3, from the transfer position 22 to the position where the drum 3 faces the cleaning device 4. Accordingly, the photoreceptor drum 3 can be deactivated before a leading end of a sheet reaches the cleaning device 4, by deactivating the motor M1 according to a voltage that the voltage detecting circuit 65 detects through the potential detecting roller 6D.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

an image bearing member for carrying a toner image in an electrophotographic image forming process; and a transferring member for transferring a toner image formed on the image bearing member to a sheet, the transferring member including:

a plurality of rollers, an endless belt stretched over the rollers, and a potential detecting device for detecting a potential of the endless belt, the potential detecting device being positioned downstream, along a sheet transport path, of a transfer position where the endless belt has direct contact with the image bearing member, wherein the image forming process is halted when the potential detecting device does not detect a change in potential caused by presence of a sheet on the endless belt.

2. The image forming apparatus according to claim 1, wherein the potential detecting device is a rotatable electrically conductive roller with a circumferential surface thereof in direct contact with the endless belt.

3. The image forming apparatus according to claim 2, wherein a distance from the transfer position to a cleaning device provided for cleaning a circumferential surface of the image bearing member is set longer than a distance from the transfer position to a position where the potential detecting device is provided.

4. The image forming apparatus according to claim 1, wherein a distance from the transfer position to a cleaning device provided for cleaning a circumferential surface of the image bearing member is set longer than a distance from the transfer position to a position where the potential detecting device is provided.

* * * * *